US005172088A

United States Patent [19]

Morgan

[11] Patent Number: 5,172,088

[45] Date of Patent: Dec. 15, 1992

[54] MOLDED CASE CIRCUIT BREAKER COMBINED ACCESSORY ACTUATOR-RESET LEVER

[75] Inventor: Roger J. Morgan, Simsbury, Conn.

[73] Assignee: General Electric Company, New York, N.Y.

[21] Appl. No.: 832,136

[22] Filed: Feb. 6, 1992

[51] Int. Cl.[5] ..... H01H 9/30

[52] U.S. Cl. ..... 335/201; 335/16

[58] Field of Search ..... 335/201, 16, 147, 195; 200/147 R, 144 R

[56] References Cited

U.S. PATENT DOCUMENTS

| | | | |
|---|---|---|---|
| 3,582,966 | 6/1971 | Strobel | 200/144 R |
| 4,086,460 | 4/1978 | Gillette | 200/144 R |
| 4,654,490 | 3/1987 | Leone et al. | 200/147 R |

*Primary Examiner*—Lincoln Donovan

*Attorney, Agent, or Firm*—Richard A. Menelly

[57] ABSTRACT

Since industrial-rated circuit breakers are often located remote from the associated protected electrical equipment it is often times necessary to monitor the operation of such electrical equipment by observing the condition of the circuit breaker contacts to ensure that such equipment remains operational. When a plurality of such circuit breakers are mounted within a common enclosure, an auxiliary device within each of the circuit breakers readily provides visual indication of the ON-OFF condition of the circuit breaker contacts. With such auxiliary devices, an actuator-reset lever is used to interface between the circuit breaker operating mechanism, the circuit breaker trip mechanism and the auxiliary device to activate the auxiliary device when the circuit breaker contacts are open and closed and to reset the trip mechanism when the circuit breaker contacts are opened.

3 Claims, 4 Drawing Sheets

MOLDED CASE CIRCUIT BREAKER COMBINED ACCESSORY ACTUATOR-RESET LEVER

This is a division of application Ser. No. 07/653,388, filed Jan. 30, 1991.

BACKGROUND OF THE INVENTION

The advent of field-installable accessories for use within industrial-rated circuit breakers has fostered the increased use of such accessories to provide remote indication of the operating conditions of related electrical equipment as well as providing means for turning such equipment ON and OFF from a remote location. U.S. Pat. No. 4,754,247 entitled "Molded Case Circuit Breaker Accessory Enclosure" describes an industrial-rated circuit breaker that includes an accessory door for facilitating the field-installation of selected accessory units within the circuit breaker cover.

U.S. Pat. No. 4,757,294 entitled "Combined Trip Unit and Accessory Module for Electronic Trip Circuit Breakers" describes a combined trip actuator mechanism and accessory unit for articulating the circuit breaker operating mechanism and interfacing with the accessory unit for remote trip as well as trip indication function.

U.S. Pat. No. 4,794,356 entitled "Molded Case Circuit Breaker Auxiliary Switch Unit" describes an auxiliary switch unit that is mounted in the circuit breaker cover and interacts with the circuit breaker operating mechanism to provide remote trip indication.

With higher-rated circuit breakers used with industrial equipment rated up to 1200 amperes continuous current, for example, a so-called "flux shifter", actuator device is required to articulate the powerful operating mechanism springs that are required with the heavier current-carrying components within the circuit breaker assembly.

U.S. Pat. No. 3,693,122 discloses one such flux transfer trip device for electronic trip units wherein the flux provided by a permanent magnet is opposed by a magneto-motive force produced by a solenoid winding. A flux diverter interposed between the permanent magnet and the spring-based tripping armature provides instantaneous trip properties by effectively de-coupling the permanent magnet flux upon operation of the solenoid winding.

When a flux shifter-trip actuator device is used in combination with an auxiliary device such as a bell alarm or auxiliary switch, for example, an interface unit is required for providing mechanical logic to the flux shifter unit, the auxiliary device and the circuit breaker operating mechanism to ensure that the operating mechanism responds to interrupt the circuit current while the auxiliary device reacts at the same time to provide remote visual indication of such interruption event. When such higher-rated circuit interrupters include separate main and arcing contacts whereby the main contacts separate before the arc occurs between the arcing contacts some means must be used to promote the transfer of the arc away from the arcing contacts.

Accordingly, one purpose of the invention is to provide a multi-functional actuator-reset unit to ensure that the operating mechanism freely responds to overcurrent conditions while such response is indicated via an auxiliary device. The actuator-reset unit also provides reset function to the flux shifter unit immediately following the overcurrent event.

Another purpose of the invention is to promote the transfer of the arc away from the arcing contacts upon contact separation under intense overcurrent conditions.

SUMMARY OF THE INVENTION

A multi-functional accessory actuator-reset unit is arranged within a circuit breaker enclosure to interact between the circuit breaker operating mechanism and the flux-shifter trip actuator mounted within the circuit breaker case and the accessory unit mounted within the circuit breaker cover. The accessory actuator-reset unit is in the form of a combined actuator-reset lever pivotally mounted to the flux shifter unit. The circuit breaker movable contact arm crossbar unit cams the actuator-reset lever and activates the accessory unit. Release of the actuator-reset lever by the crossbar automatically resets the flux shifter. An insulation fiber between the fixed main and arcing contacts promotes the transfer of the arc to the arc runner when the circuit breaker contacts become separated under intense overcurrent conditions.

DESCRIPTION OF THE PREFERRED EMBODIMENT

Figure 1:
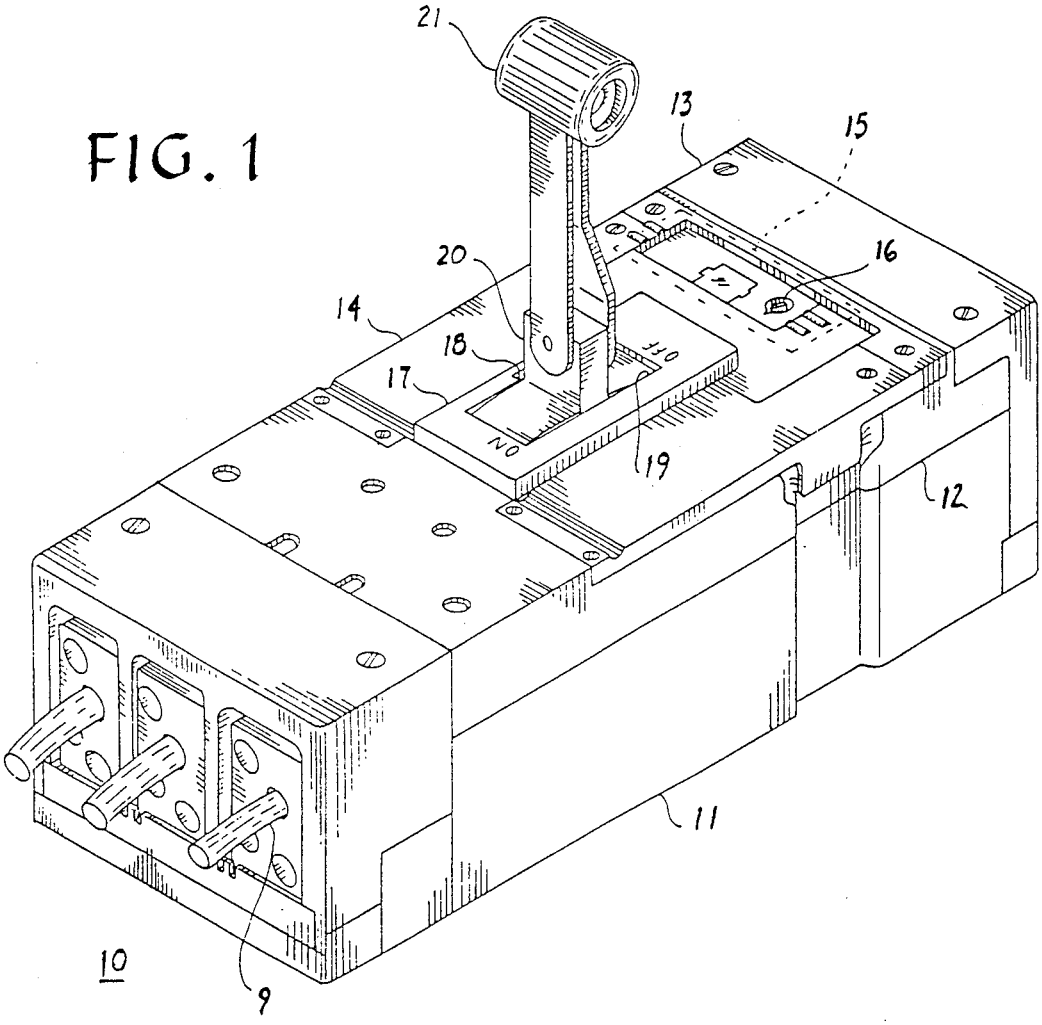
FIG. 1 is a top perspective view of an industrial-rated circuit breaker incorporating the combined accessory actuator-reset unit according to the invention.

An industrial-rated circuit breaker 10 is depicted in FIG. 1 and consists of a molded plastic case 11 to which a molded plastic cover 12 is securely fastened. An accessory cover 14 such as described within aforementioned U.S. Pat. No. 4,754,247 is used to provide access to the various circuit breaker accessories that are completely field-installable within the circuit breaker cover. An electronic trip unit 15 is also arranged within the circuit breaker cover for providing overcurrent determination as well as electronic accessory function. One such electronic trip unit is described within U.S. Pat. No. 4,589,052. An externally accessible knob 16 is used for setting the circuit breaker trip parameters. The compact circuit breaker is capable of providing circuit interruption at increased ampere ratings by the provision of a lug cover-exhaust chamber 13 which is arranged on the line end of the breaker proximate the incoming power cables 9. An operating mechanism 22 (FIG. 2) is used to interrupt the circuit current by the bias provided by a pair of powerful operating springs 23 such as described in U.S. patent application Ser. No. 546,826 filed Jun. 29, 1990 entitled "Compact Molded Case Circuit Breaker with Increased Ampere Rating". All of the aforementioned U.S. Patents and U.S. Patent Application are incorporated herein for reference purposes. Due to the increased loading force applied to the operating mechanism by the operating springs, it is difficult to manually displace the circuit breaker operating handle 20 to turn the circuit breaker contacts 24, 25 (FIG. 2) between their closed and open positions as well as to reset the circuit breaker operating mechanism. To increase the force acting on the operating handle, a retractable handle extension 21 is fixedly attached to the operating handle which allows the operating handle to swing freely within the handle access slot 19 and provide sufficient force on the operating mechanism to reset and to close the circuit breaker contacts. A visual access slot 18 is arranged through the cover next to the cover escutcheon 17 to visually ascertain the condition of the circuit breaker contacts.

Figure 2:
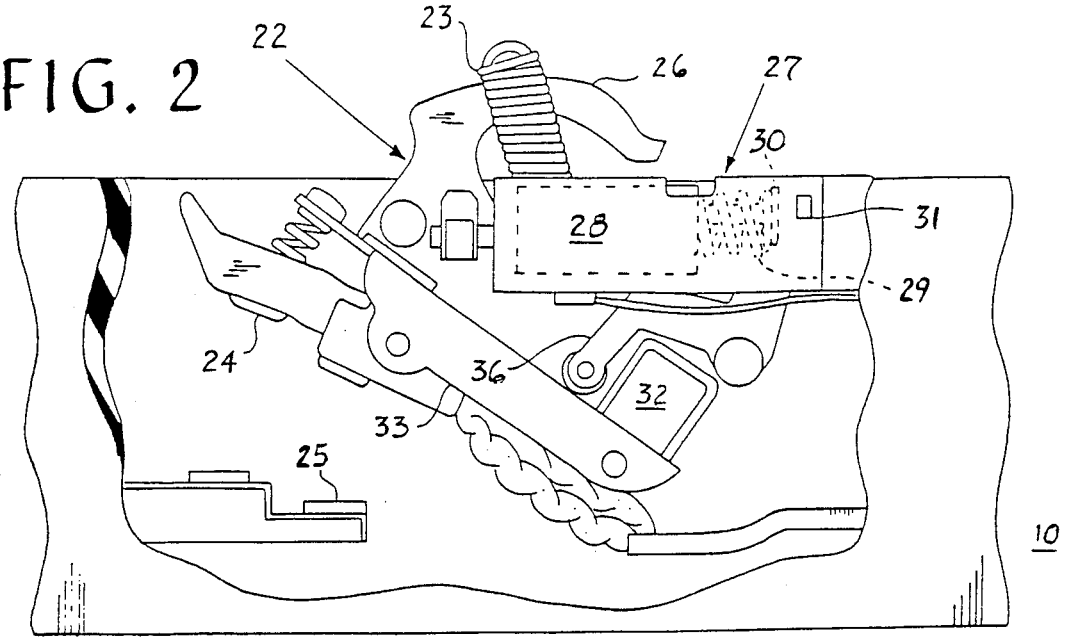
FIG. 2 is a cut-away side view of the circuit breaker of FIG. 1 depicting the circuit breaker trip actuator unit.

The circuit breaker 10 shown in FIG. 2 employs an operating mechanism 22 with associated operating springs 23 to drive the movable contact arm 33 and attached movable contacts 24 away from the fixed contacts 25 upon occurrence of an overcurrent condition. The cradle operator 26 restrains the operating springs in the absence of any such overcurrent condition and becomes disengaged by means of a trip bar 31 to articulate the operating springs. The trip bar is contacted by means of a trip actuator 27 in the form of a flux shifter as described within the aforementioned U.S. Pat. No. 3,693,122 and basically comprises an electromagnetic coil 28 that releases the movable armature 30 under the bias provided by the powerful compression spring 29. Upon the occurrence of an overcurrent condition, a current pulse applied to the electromagnetic coil counteracts the magnetic holding force on the armature and allows the armature to be rapidly driven forward under the bias of the compression spring into contact with the trip bar to thereby release the cradle. In accordance with the invention, an accessory actuator and flux shifter reset unit 36 hereafter "actuator-reset unit" interacts with the crossbar 32 on the movable contact arm 33 and the trip actuator 27 to reset the armature 30 against the bias provided by the compression spring in the manner best seen by referring now to the following FIGS. 3–5.

Figure 3:
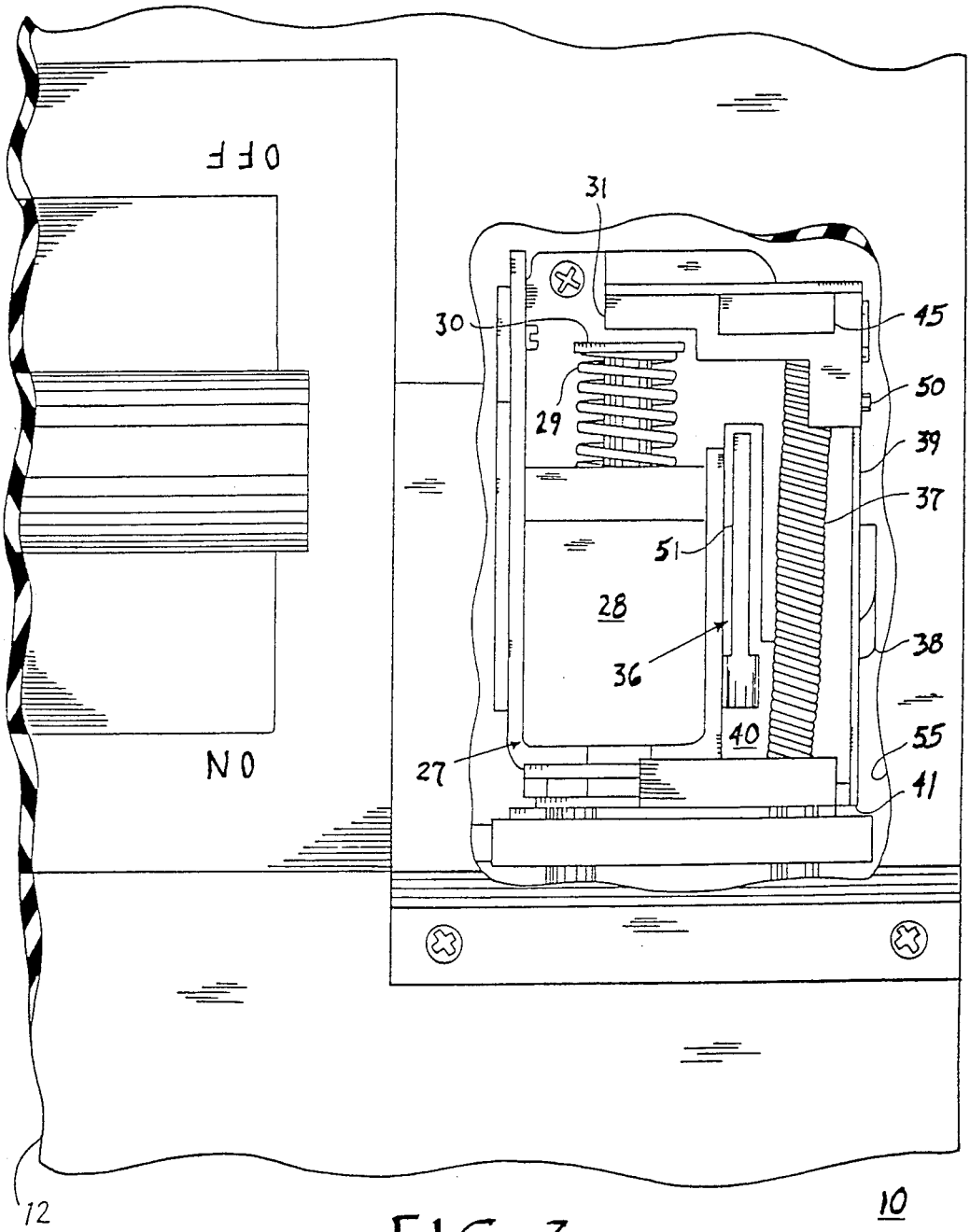
FIG. 3 is an enlarged top plan view of a part of the circuit breaker of FIG. 2 depicting the accessory actuator-reset unit of the invention next to the circuit breaker trip actuator unit.

In FIG. 3, the trip actuator 27 is viewed through the cover 12 of the circuit breaker 10 with the actuator-reset unit 36 attached to the trip actuator by means of a pivot pin 50. The actuator-reset unit 36 is positioned next to the trip actuator to allow free movement of the armature 30 into contact with the trip bar 31 when the electromagnetic coil 28 becomes energized. The reset lever 45 on the actuator-reset unit returns the armature to the reset position under the return bias of the reset spring 37 when the circuit breaker operating mechanism is manually actuated to close the contacts in the manner to be described below in greater detail. The accessory lever 51 interacts with the accessory unit 54 shown in FIGS. 4 and 5 but which is removed from FIG. 3 for purposes of clarity. The accessory unit is in the form of an auxiliary switch which sits within the accessory recess 55 in the cover immediately above the trip actuator and actuator-reset lever 36. To protect the reset spring 37 from the gaseous by-products that occur during arcing between the contacts upon contact separation under overcurrent conditions, a fiber shield 38 is arranged about the reset spring and includes a side part 39, bottom part 40 and end part 41. The fiber shield also shields the pivot pin 50 from the gaseous by-products to ensure the long term operation of both the reset lever 45 and the accessory lever 51.

Figure 4:
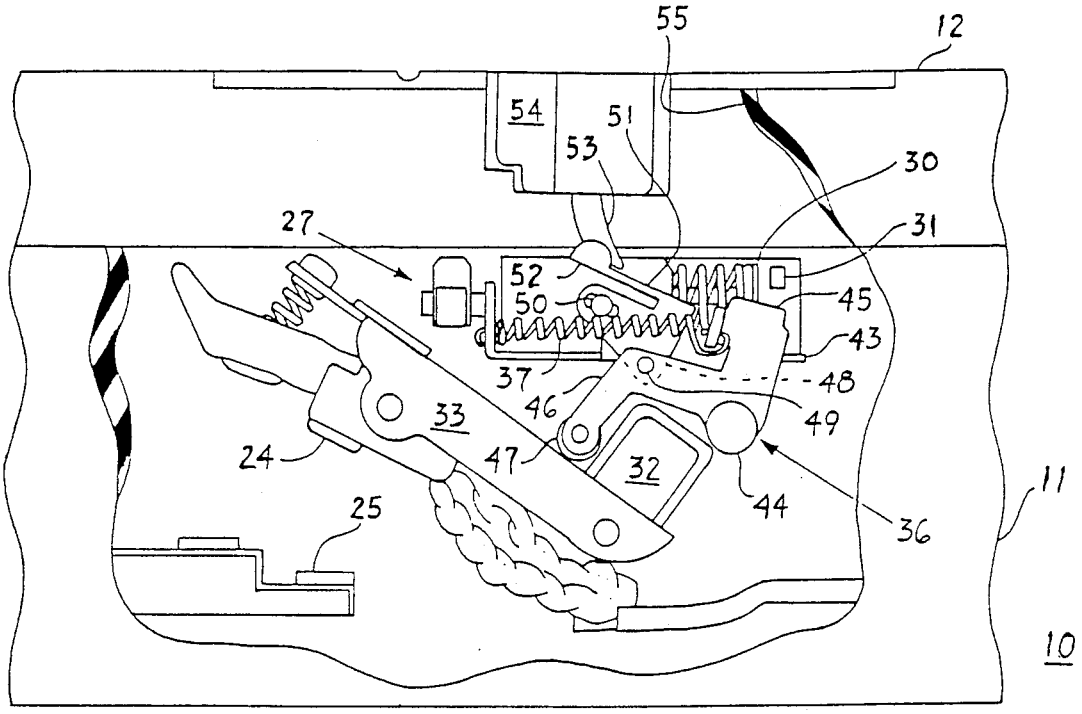
FIG. 4 is an enlarged side view of the circuit breaker of FIG. 1 in partial section depicting the accessory actuator-reset unit according to the invention with the circuit breaker contacts separated.

The operation of the actuator-reset unit 36 is best seen by referring now to the circuit breaker 10 shown in FIG. 4 where the movable contact arm 33 has responded to separate the contacts 24, 25 and the crossbar 32 on the movable contact arm has rotated away from the roller 47 on the end of the interface lever 46. The interface lever forms one part of the actuator-reset lever 36 and provides mechanical logic to the auxiliary switch unit 54 located within the accessory recess 55 in the cover 12 above the case 11. The other part of the actuator-reset lever comprises the reset lever 45 which is driven into contact with the armature 30 to reset the armature away from the trip bar 31 as described earlier. The actuator-reset unit 36 is pivotally attached to the housing 43, which supports the trip actuator 27, by means of a second pivot pin 44. The reset spring 37 extends between the housing and the reset lever to bias the reset lever into contact with the armature 30 as shown in FIG. 4. At the same time, the interface lever 48 which connects with the actuator-reset unit by means of pivots 49 and 50, rotates clockwise about pivot pin 50 to drive the U-shaped end 52 of the attached accessory lever 51 into contact with the accessory unit lever 53 depending from the bottom of the accessory unit 54. This indicates to a remote operator that the circuit breaker contacts have become separated and that circuit current to the related electrical equipment has become interrupted.

Figure 5:
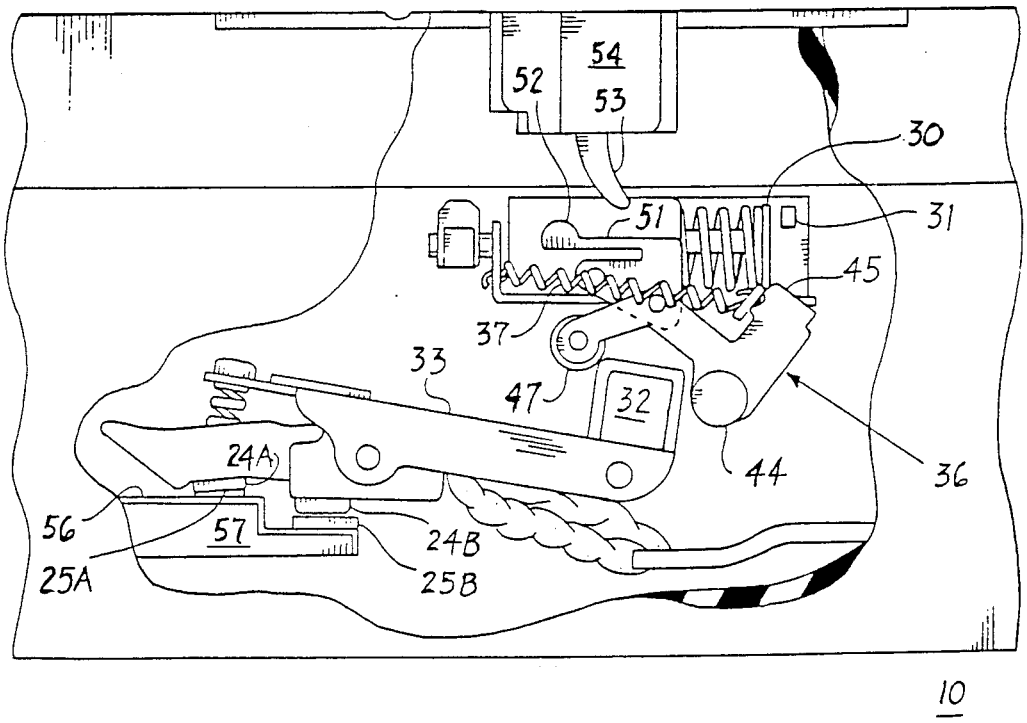
FIG. 5 is an enlarged side view in partial section of the circuit breaker of FIG. 4 with the circuit breaker contacts engaged.

Upon closing the contacts by moving the movable contact arm 33 to the closed position indicated in FIG. 5, the roller 47 follows the contour of the crossbar 32 to thereby rotate the actuator-reset unit 36 in the clockwise direction about pivot pin 44 and thereby move the reset lever 45 away from the armature 30 allowing the armature to next contact the trip bar 31 upon the occasion of a succeeding overcurrent condition. The reset spring 37 is stretched to its maximum elongation and the U-shaped end 52 of the accessory lever 51 is rotated counterclockwise away from the accessory unit lever 53 on the accessory unit 54 to indicate to the remote operator that the circuit breaker contacts have closed and that the associated electrical equipment is once again operational.

The contacts are herein designated as the main movable contacts 24A and the arcing movable contacts 24B to more fully describe the formation and control of the arc that occurs when such contacts become separated under intense overcurrent conditions. The main moving contacts 24B separate from the main fixed contacts 25B on the line strap 57 before the movable arcing contacts 24A become separated from the fixed arcing contact 25A. To deter the transfer of the arc from the arcing contacts to the line strap, an insulating fiber or polyester strip 56 is positioned on the line strap, as indicated.

Figure 6:
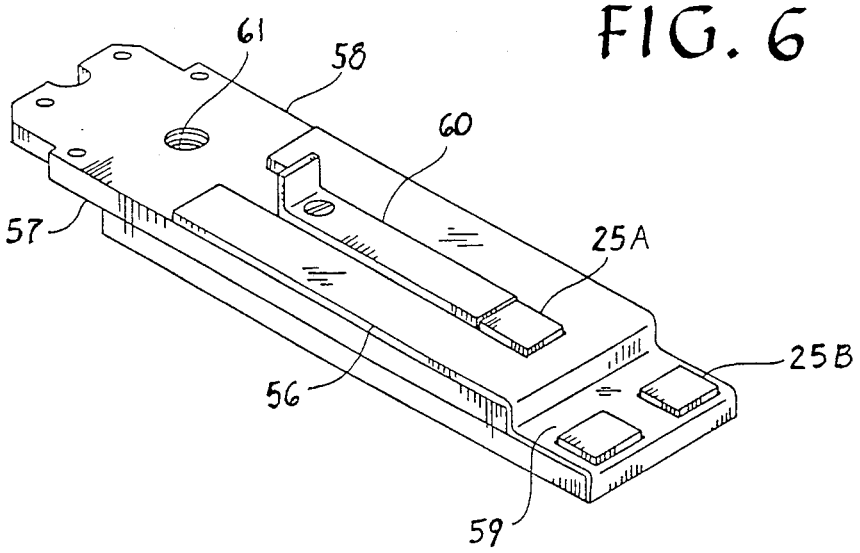
FIG. 6 is a top perspective view of the line strap used within the circuit breaker of FIG. 5.

The embedment of the fixed main contact 25B and the fixed arcing contacts 25A within the insulation fiber strip 56 is best seen by referring to the line strap 57 shown in FIG. 6 prior to assembly. The line strap comprises an upper step 58 which supports the fixed arcing contact 25A as well as the arc runner 60 and line contact terminal threaded opening 61. The fixed main contacts 25B are attached to a lower step 59 which also contains the insulation strip 56. The insulation strip extends along both sides of the arc runner to isolate the extent of the line strap from the arc and thereby promotes the direct transfer of the arc from the fixed arcing contact 25A to the arc runner 60 to prevent the arc from rooting on the line strap during intense circuit interruption conditions.

An accessory actuator-reset unit has herein been described which interacts between the circuit breaker operating mechanism, the trip actuator and an accessory unit to both activate and de-activate the accessory while at the same time automatically resetting the trip actuator unit. Also described is a means for promoting the transfer of the arc to the arc runner within higher-rated circuit breakers employing main and arcing contacts.

Having thus described our invention, what we claim as new and desire to secure by Letters Patent is:

1. A molded case circuit breaker comprising in combination:

a molded plastic case and cover;

a main movable contact and a main fixed contact within said case arranged for transferring steady state circuit current;

an arcing movable contact and an arcing fixed contact within said case and arranged for transferring fault current to an arc runner;

an operating mechanism within said case separating said main movable and fixed contacts upon occurrence of said fault current and then separating said arcing movable and fixed contacts thereby transferring said fault current to said arc runner; and said main fixed contact and said main arcing contact being arranged on a common line strap, said line strap including insulation means covering said line strap except for said main fixed contact, said arcing fixed contact and said arc runners, said common line strap comprising an upper and lower stepped surface said main fixed contact being arranged on said upper stepped surface and said arcing fixed contact being arranged on said lower stepped surface.

2. The circuit breaker of claim 1 wherein said arc runner is arranged on said upper stepped surface.

3. The circuit breaker of claim 1 wherein said insulation means comprises a fiber strip.

* * * * *

UNITED STATES PATENT AND TRADEMARK OFFICE

CERTIFICATE OF CORRECTION

PATENT NO. : 5,172,088

DATED : 12/15/92

INVENTOR(S) : IRENAEUS S. PANUS ET AL.

It is certified that error appears in the above-indentified patent and that said Letters Patent is hereby corrected as shown below:

On the title page, under item [19], change "Morgan" to --Panus-- and item [75], change "Roger J. Morgan" to --

Irenaeus S. Panus, Forestville Connecticut; Ronald G. Pekrul, Southington Connecticut; Robert A. Morris, Burlington, Connecticut; Thomas F. Papallo, Jr., Plainville Connecticut; Roger J. Morgan--

Signed and Sealed this

Twenty-third Day of November, 1993

*Attest:*

*Attesting Officer*

Bruce Lehman

BRUCE LEHMAN

*Commissioner of Patents and Trademarks*